US012722744B2

(12) United States Patent
Vanoise

(10) Patent No.: US 12,722,744 B2
(45) Date of Patent: Sep. 1, 2026

(54) INFLATABLE CRAFT, IN PARTICULAR OF THE CANOE TYPE, AND METHOD FOR MANUFACTURING SAID CRAFT

(71) Applicant: SAFE BOAT EQUIPMENT, Blessy (FR)

(72) Inventor: Jean-Luc Vanoise, Blessy (FR)

(73) Assignee: SAFE BOAT EQUIPMENT, Blessy (FR)

( * ) Notice: Subject to any disclaimer, the term of this patent is extended or adjusted under 35 U.S.C. 154(b) by 339 days.

(21) Appl. No.: 18/577,319

(22) PCT Filed: Jul. 6, 2022

(86) PCT No.: PCT/FR2022/051360

§ 371 (c)(1),
(2) Date: Jan. 8, 2024

(87) PCT Pub. No.: WO2023/281219

PCT Pub. Date: Jan. 12, 2023

(65) Prior Publication Data

US 2024/0308622 A1 Sep. 19, 2024

(30) Foreign Application Priority Data

Jul. 8, 2021 (FR) ..... 2107392

(51) Int. Cl.
*B63B 7/08* (2020.01)
*B63B 7/00* (2020.01)

(52) U.S. Cl.
CPC ..... *B63B 7/087* (2013.01); *B63B 2007/006* (2013.01)

(58) Field of Classification Search
CPC ..... B63B 7/08; B63B 7/087; B63B 2007/006
See application file for complete search history.

(56) References Cited

U.S. PATENT DOCUMENTS

| | | | | |
|---|---|---|---|---|
| 4,329,751 | A * | 5/1982 | Cigognetti | B63B 27/146 114/355 |
| 4,660,497 | A | 4/1987 | Cochran | |
| 5,601,461 | A | 2/1997 | Mills | |
| 2015/0059635 | A1* | 3/2015 | Fritsch | B63B 7/08 114/345 |
| 2016/0200406 | A1 | 7/2016 | Schaefer | |

FOREIGN PATENT DOCUMENTS

| | | | |
|---|---|---|---|
| DE | 2941175 | A1 | 4/1981 |
| EP | 0060409 | B1 | 8/1985 |
| FR | 2243861 | A1 | 4/1975 |
| FR | 2462333 | A1 | 2/1981 |
| FR | 2464178 | A1 | 3/1981 |

OTHER PUBLICATIONS

International Search Report from International Application No. PCT/FR2022/051360 Oct. 11, 2022, 3 pgs.

* cited by examiner

*Primary Examiner* — Sabbir Hasan
(74) *Attorney, Agent, or Firm* — Tutunjian & Bitetto, P.C.

(57) ABSTRACT

The present invention relates to a method for manufacturing an inflatable craft and to the inflatable craft thus obtained. The craft being of the canoe type and including at least one float that includes an inflatable portion providing flotation and a textile envelope. The textile envelope receives the inflatable portion and provides the shape and the mechanical strength of the float.

14 Claims, 4 Drawing Sheets

INFLATABLE CRAFT, IN PARTICULAR OF THE CANOE TYPE, AND METHOD FOR MANUFACTURING SAID CRAFT

TECHNICAL FIELD

The invention lies in the technical field of shipbuilding and more particularly the manufacture of inflatable boats and crafts.

The method can be used to produce crafts that can be used for various applications, for example in the military, civil security, fishing, pleasure and sport fields.

PRIOR ART

Numerous examples of the construction of inflatable crafts are known to date. The manufacturing technique essentially consists of cutting and assembling pieces of fabric, in particular by gluing or ultrasonic welding to produce the floats, the latter providing the flotation of the craft.

These floats are then connected together by a hull which can be pneumatic or rigid. This manufacturing technique allows to build robust crafts, however it has various disadvantages. On the one hand, the fabric used to produce the floats or tubes must meet numerous features because the fabric layer must both have waterproofing properties and mechanical and chemical strength.

On a mechanical level, the fabric layer must withstand shocks during navigation, or even abrasion and the risk of perforation and cuts. At the chemical level, the fabric layer must withstand the specific conditions related to marine use and in particular be resistant to sea water, hydrocarbons or else ultraviolet light.

For this purpose, in practice, the fabric layer comprises at least one layer of thick elastomer, with a thickness greater than 400 microns, the surface of which is treated or covered by another protective layer, in particular by coating. The whole is relatively heavy and, even when deflated, occupies a significant volume. For example, a standard craft of around 4.5 to 5 m long weighs 120 kg to 140 kg for the inflatable portion.

On the other hand, this type of craft requires specific know-how and tools for its repair in the event of damage to an inflatable portion and in particular in the event of tearing of a float. In the event of significant damage, it may be necessary to completely replace the inflatable portion, which involves immobilizing the craft during the work.

Moreover, this type of manufacturing allows little variation in shapes, in particular given the complexity of assembling the layers together to obtain angles or profile variations.

Finally, the structure of these crafts also has floats placed very high in relation to the bottom of the craft, making transshipment operations difficult.

SUMMARY OF THE INVENTION

The present invention aims at eliminating these aforementioned disadvantages and at proposing an inflatable craft whose inflatable portion is relatively light, easy to replace and allowing the production of mechanically resistant crafts, in particular to tears, and which can have varied profiles.

To this end, according to the invention, the inflatable craft includes at least one float that comprises at least one inflatable portion providing flotation and a textile envelope, said textile envelope being configured to receive the at least one inflatable portion and to provide the shape and the mechanical strength of said float. According to one embodiment, a single inflatable portion is housed in the textile envelope. Variants are however possible with two or more than two inflatable portions housed in the textile envelope, depending on the general shape of the float.

The person skilled in the art will understand that the textile envelope is presented as a flexible sleeve that can be deformed in order to reduce its space requirement in stored mode but which is not extensible, or even possibly slightly extensible over one or more areas, one or more inflatable portions being inserted into this flexible sleeve. During inflation, the inflatable portion(s) increase in volume and press against the internal wall of the non-extensible sleeve, which gives shape to the float.

According to one embodiment of the craft, it is of the canoe type. Other crafts are however possible, for example bridged crafts with or without a mast and which can be propelled by oars, engine or sail, or even inflatable buoys with or without a bottom or inflatable floating mattresses.

According to one embodiment of the inflatable craft, the float is substantially V- or U-shaped with two longitudinal arms, said textile envelope providing the reception of the inflatable portion and the connection between the two longitudinal arms by a central connection area. Other shapes of floats are possible according to the invention, for example a shape of torus having a central orifice which is closed by a bottom whose periphery is connected to said torus. According to one embodiment of the inflatable craft, the textile envelope is made from straight, warp and weft knitting in three dimensions (3D). Other types of knitting could be considered without departing from the scope of the invention.

According to one embodiment of the inflatable craft, the textile envelope includes at least one increase area to locally allow an increase in the diameter of the inflatable portion so as to produce a float profile of greater section. However, it is possible to consider a textile envelope having a uniform cross section over the entire length of said textile envelope.

According to one embodiment of the inflatable craft, a bow of the craft comprises an increase area for seakeeping at said bow of the craft, the textile envelope having a mesh whose size is increased by 2% to 20% in said increase area. In other words, the size of the mesh located at the bow of the craft is increased between 2% and 20% compared to the size of the mesh located outside said bow.

Depending on the inflatable craft, the textile envelope includes at least one section reduction area with a reduction in the number of meshes per row comprised between 1% and 20% allowing a float profile of lower section.

According to one embodiment of the inflatable craft, a knitted fabric of the textile envelope includes at least one flexible area, at least at one front and/or rear end of the craft, wherein the knitted fabric is made from a low tenacity elastic yarn to allow the limitation of overpressures due to thermal expansion. This avoids the addition of pressure relief screws on the at least one inflatable portion. Preferably, the low tenacity elastic yarn has an elasticity allowing elongation comprised between 5% and 15%.

Depending on the inflatable craft, the central connection area comprises means for receiving a floor. According to one embodiment, a floor dock is mounted on a pivot, the float including means for blocking the dock in a substantially vertical position to provide reception of a support and inclination system for a drive portion of an engine.

Depending on the inflatable craft, the textile envelope comprises means for inserting and removing the inflatable portion. This facilitates the installation of the inflatable portion in the textile envelope and, conversely, its release therefrom, for example when it needs to be replaced. According to one embodiment, the insertion and removal means include at least two orifices each including a cover associated with a connection allowing traction for the passage of the inflatable portion into the textile envelope.

According to one embodiment of the inflatable craft, it comprises at least one fin removably mounted on the float. Removing the fin will make it easier to store the craft when it is deflated, in the form of a bag.

According to one embodiment of the craft, the float is substantially V- or U-shaped with two longitudinal arms and a central connection area connecting the two longitudinal arms. Furthermore, said central connection area is raised relative to a lower side of the float and includes on its lower face means for receiving a propulsion machine. This allows a propulsion device to be fixed under the float while keeping it out of the water.

According to one embodiment of the inflatable craft, the float is substantially V- or U-shaped with two longitudinal arms and comprises a lower side. Furthermore, at least one reinforcing rib is arranged on the textile envelope in the longitudinal direction of the longitudinal arms, on said lower side and on each of said two longitudinal arms. Such longitudinal ribs on the lower side of each longitudinal arm of the float allow to drag the craft over irregular, hard and/or rough surfaces, reducing direct contact with said textile envelope, which limits its degradation. According to a preferred implementation of this embodiment, the textile envelope is implemented by knitting, said at least one rib on each of said longitudinal arms being implemented directly by knitting said textile envelope. Thus, the ribs are formed directly on the textile envelope during the knitting thereof, the textile envelope and the ribs forming a single piece. This avoids adding ribs onto the textile envelope by means of glue, welds or seams and therefore offers better resistance to tearing.

The inflatable craft may implement various embodiments comprising all or part of the features described above, while remaining within the scope of the present invention.

The invention further relates to a method for manufacturing an inflatable craft, said method essentially including a step of manufacturing by integral knitting with picked meshes of a textile envelope without seam at the general structure of the envelope, a step of manufacturing an inflatable portion in the form of a cylinder closed at the ends, a step of inserting the inflatable portion into the textile envelope. Obviously, the inflation of the inflatable craft can be carried out subsequently to the manufacture of said craft, at the time of use thereof, thanks to a step of inflating the inflatable portion disposed in the textile portion which will allow its deployment and that of the textile envelope until the latter is tensioned. A first inflation at the time of manufacture may also be carried out in order to check the conformity of the manufactured craft.

Advantages Provided

A first purpose of the present invention is to overcome all or part of the technical problems related to the aforementioned prior art.

Another purpose of the present invention is to provide an inflatable craft whose profile has complex variations in section using an inflatable portion of substantially cylindrical section.

Another purpose of the present invention is to provide an inflatable craft whose inflatable portion can easily be replaced and/or repaired.

Another purpose of the present invention is to propose an inflatable craft whose weight and storage volume are low and of the order of 40 kg and 50 liters (or $dm^3$) for a craft which can reach up to 5 m in length.

Another purpose of the present invention is to provide an inflatable craft wherein the inflatable portion is protected from the external environment and in particular from the risk of perforation or else ultraviolet light.

Another purpose of the present invention is to provide an inflatable craft wherein the float better withstands stress when said craft is dragged over an irregular, hard and/or rough surface, for example when docking on a bedrock or rocky surface by the seaside.

Another purpose of the present invention is to propose a method for manufacturing a craft allowing to avoid cutting and gluing the different layers of fabric to produce the inflatable portion.

Another purpose of the present invention is to propose a method for manufacturing a craft allowing to limit labor and whose textile envelope can be produced without sewing on a 3D weaving loom with picked meshes.

BRIEF DESCRIPTION OF THE FIGURES

The features and advantages of the present invention will emerge from the description below with reference to the appended figures illustrating a plurality of exemplary embodiments which are devoid of any limiting character and wherein.

DETAILED DESCRIPTION

Figure 1:
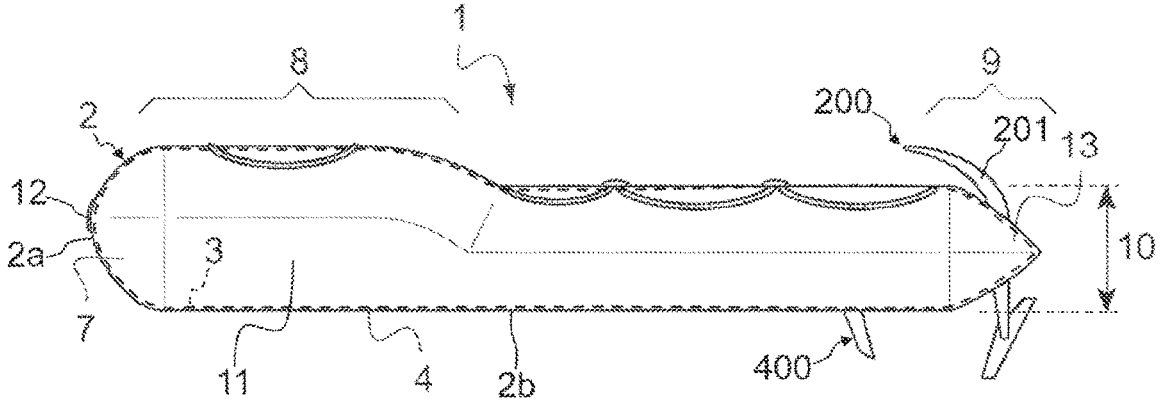
FIG. 1 shows a side view of an exemplary embodiment of an inflatable craft in accordance with the invention.

The present invention aims at protecting an inflatable craft 1, in particular of the canoe type. Referring to FIG. 1 an example of this canoe is seen. However, the craft 1 is not limited to a canoe, namely a small craft without a bridge, and it is indeed also possible to produce crafts, in accordance with the invention, bridged with or without a mast and which can be propelled by oars, engine or else sail.

Figure 2:
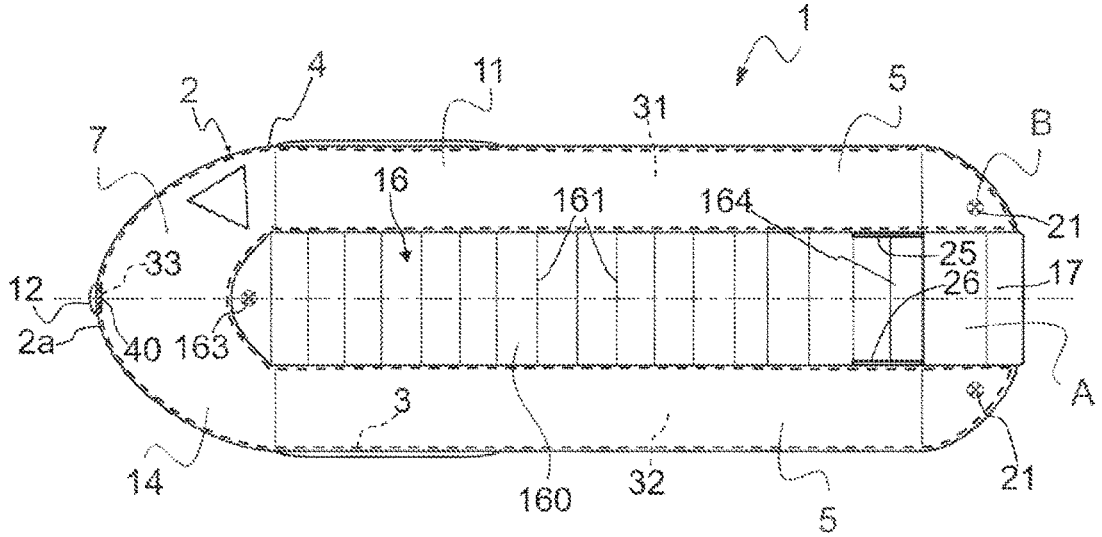
FIG. 2 shows a top view of the inflatable craft shown in FIG. 1.
Figure 3:
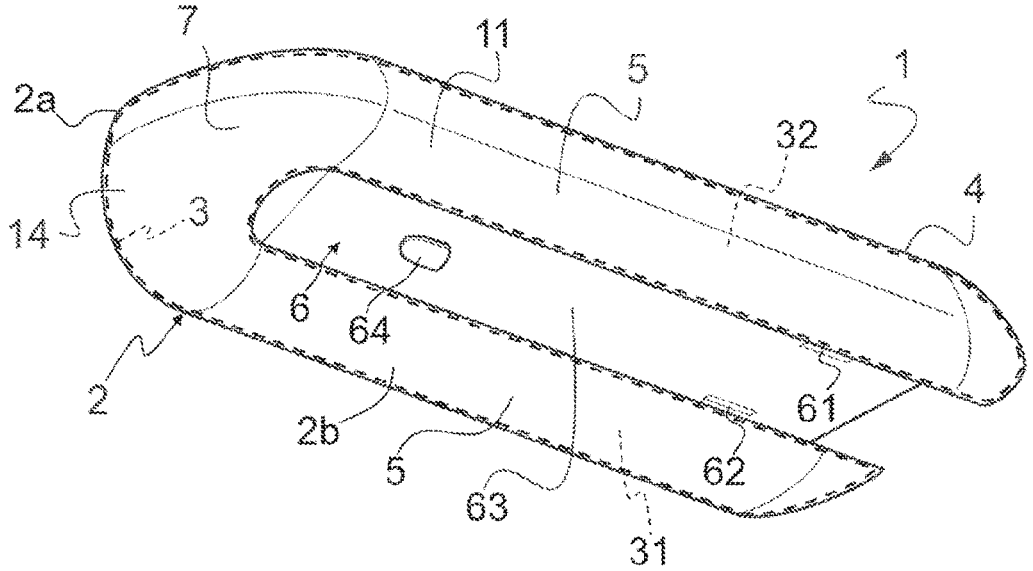
FIG. 3 shows a bottom view of the inflatable craft shown in FIGS. 1 and 2.

According to an inventive aspect of the invention, the craft 1 comprises at least one float 2, said float 2 including an inflatable portion 3 providing flotation and a textile envelope 4. The textile envelope 4 has a geometry allowing to receive the inflatable portion 3, this textile envelope 4 provides the shape and the mechanical strength of said float 2. In FIGS. 1 to 3, the inflatable portion 3 is illustrated in dotted lines and is slightly detached from the internal wall of the textile envelope 4, only in order to visualize this inflatable portion 3. The person skilled in the art will understand that in reality the inflatable portion 3 is pressed against the internal wall of the textile envelope 4 once inflated.

In the exemplary embodiment of the appended figures, the float 2 is substantially V- or U-shaped with two longitudinal arms 5, said textile envelope 4 providing the reception of the inflatable portion 3 and the connection between the two longitudinal arms 5 by means of a central connection area 6. Variants of closed floats, having for example an O shape or an oval shape, for example a life raft, a canoe or a kayak could be considered.

According to the implementation of FIGS. 1 to 10, a single inflatable portion 3 is provided and also has the shape of a V or U, forming two longitudinal branches 31, 32, so as to be housed in the textile envelope 4. However, provision could be made of a variant with two inflatable portions being housed in the textile envelope 4, respectively in the two symmetrical portions of the V or U shape of the float 2.

In other types of configuration, the textile envelope 4 may be limited to receiving the inflatable portion 3, the connection between the longitudinal arms 5 being provided by other means and for example by a shell, a bridge or else another textile piece or not.

Referring to FIG. 2 showing a top view of the craft 1, or optionally to FIG. 3 showing a bottom view of the craft 1, it is seen that the central connection area 6 is also advantageously connected to the top 7 of the float 2 constituting the bow of the craft 1 and connecting the two longitudinal arms 5.

For the production of the textile envelope 4, machines with rectilinear needle beds are advantageously used allowing the seamless production of the textile envelope 4. The textile envelope 4 produced from rectilinear knitting, warp and weft in 3D, allows complex profile shapes to be given to the float 2 of the craft 1 from a simple and in particular cylindrical shape of the inflatable portion 3. This knitting is preferably carried out using a high tenacity polyester yarn.

Indeed, the inflation of the inflatable portion 3 previously inserted into the textile envelope 4 takes place until the textile envelope 4 is tensioned. The inflatable portion 3 thus relaxes locally depending on the space allowed by the textile envelope 4. To this end, it is planned that the inflatable portion 3 is made of a material allowing an expansion comprised between 100% and 300%.

To allow a variation in the profile of the float 2, increase 8 and reduction 9 areas are provided allowing to obtain respectively an enlargement or a shrinkage of the section 10 of the float 2. Referring again to FIG. 1, the knitted fabric 11 of the textile envelope 4 includes at least one increase area 8 which locally allows an increase in the diameter of the inflatable portion 3 at the top 7 and the front segments of the longitudinal arms 5 of the float 2, so as to produce a profile of float 2 of section 10 greater than that defined at the rear segments of said longitudinal arms 5. Preferably, this at least one increase area 8 is implemented by a method for loosening the mesh of the knitted fabric. The presence of an increase area 8 at the bow of the craft 1 allows better stability during navigation.

According to a first embodiment, the at least one increase area 8 is obtained by increasing the size of the mesh, by adding the length of yarn absorbed per mesh. This technique could in particular be implemented in sections requiring a small increase in section 10.

In particular, an increase area 8 is provided for seakeeping at the bow of the craft 1 and wherein the increase in the size of the mesh is comprised between 2% and 20% of the mesh.

According to a second embodiment, the at least one increase area 8 is obtained by creating additional wales for each new row. Each additional wale allowing a local increase in the dimensions of the textile envelope 4 and thus allows a greater expansion of the inflatable portion 3 and consequently an increase in the section 10 of the float 2 in said increase area 8. Provision is thus made of an increase area 8 at the bow of the craft 1.

Similarly to said at least one increase area 8, the knitted fabric 11 of the textile envelope 4 includes at least one reduction area 9 of the section 10 which extends the longitudinal arm 5 towards the rear. For this purpose, a reduction in the number of meshes per row comprised between 1% and 20% is carried out, allowing a profile of float 2 of section 10 less than that defined at the rear segments of said longitudinal arms 5. A reduction area 9 is thus provided at the rear ends 13 of the longitudinal arms 5. In particular, from a number of cylinder chains comprised between 500 and 600, a reduction of 100 and 120 respectively can be made. With these increase and reduction techniques, it is relatively possible to propose a float profile 2 having successions of increasing, constant or decreasing sections and to propose crafts 1 having varied profiles from inflatable portions 3 of simple and standardized shapes. Crafts 1 may be subject to significant temperature variation stresses, depending on the conditions of use. In order to avoid using overpressure screws, the knitted fabric 11 of the textile envelope 4 includes at least one flexible area 14, for example on the bow side and/or the stern side of the craft 1.

In particular, at least at one front and/or rear end of the craft 1, it is provided that the knitted fabric 11 is made from a low tenacity elastic yarn to allow the limitation of overpressures due to thermal expansion.

Advantageously, the flexible area(s) 14 can be combined with the increase areas 8 or reduction areas 9 in order to reinforce the effects of elasticity and flexibility.

Advantageously, the elastic yarn has an elasticity allowing an elongation comprised between 5% and 15% and advantageously 10%. The yarn could in particular be made of low tenacity polyester.

Figure 4:
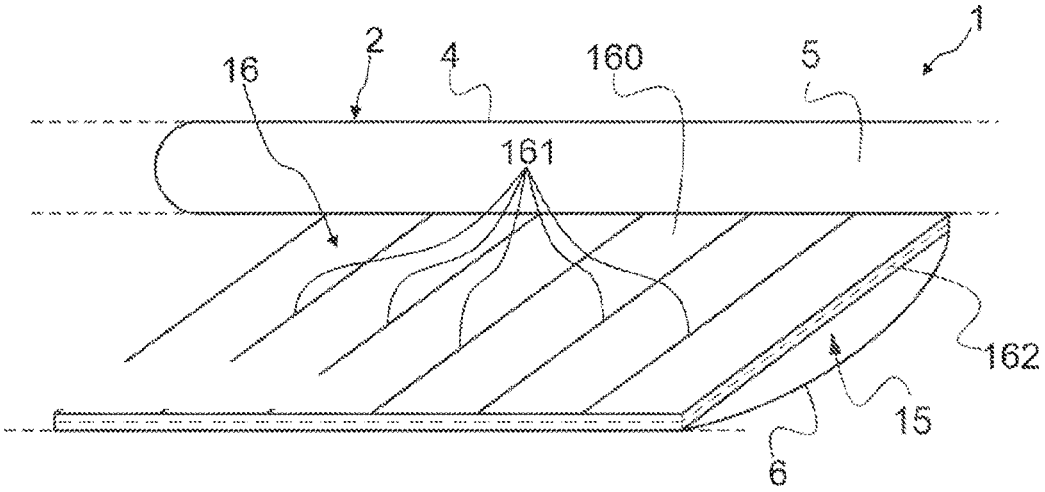
FIG. 4 shows a detail of the floor of the inflatable craft.

Referring to FIG. 4 it is seen that the central connection area 6 of the textile envelope 4 comprises means 15 for receiving a floor 16.

Referring to FIGS. 1 to 3, the craft 1 comprises two fins 400 (only one visible in FIG. 1) which are removably mounted on the central connection area 6, at the stern of the craft 1 and respectively near the two longitudinal arms 5 of the textile envelope 4. Their removable nature allows to reduce the space requirement of the craft 1 when it is stored in packing mode. For this purpose, the central connection area 6 comprises two slots 61, 62 which respectively receive the two fins 400 by snapping. The two fins 400 are introduced into the slots 61, 62 through the upper face of the central connection area 6 before the installation of the floor 16.

Referring to FIG. 3, the lower face 63 of the central connection area 6 comprises a fixing member 64 which will allow a propulsion machine (not illustrated) of the missile reactor type to be attached to this lower face 63, which will remain outside of water thanks to the upward shift of the central connection area 6 relative to the lower side **2*b* of the float 2. This will allow very rapid movement of the craft 1, for example to intervene quickly on a location or to escape quickly in case of danger, as part of a rescue mission. The propulsion machine can be supplied with fuel from the fuel tank (not illustrated) of the engine 200, thanks to a bypass device allowing the fuel supply to be switched to the engine 200** or to the propulsion machine.

In the exemplary embodiment of FIG. 4, the floor 16 is placed between the longitudinal arms 5 of the float 2 and rests on the central connection area 6. The tension exerted by the textile envelope 4 between the longitudinal arms 5, on the one hand, and the dimensions of the floor 16, on the other hand, are sufficient to maintain the latter.

However, in variant embodiments, means are provided at the floor 16 for securing to the central connection area 6 and in particular by loop/hook type attachment strips more regularly known as Velcro® strips.

Other means of securing within the reach of the person skilled in the art can of course also be considered.

The floor 16 is deformable, in order to allow the entire craft 1 to be stored in the form of a package or a bag (not illustrated), when the inflatable portion 3 is deflated, which will allow easily carrying said package or bag, which will be equipped with straps, handles and/or shoulder straps to carry it with one hand, over the shoulder or on the back.

Preferably, the floor 16 is composed on the upper surface of a textile layer 160 offering flexibility and being preferably resistant to high temperatures, and of elongated reinforcing elements 161 disposed transversely and distributed uniformly over the length of the textile layer 160, as illustrated for example in FIG. 2, in order to stiffen the floor 16 in addition to the central connection area 6 which is stretched between the two longitudinal arms 5. These elongated reinforcing elements 161 are preferably rods made of composite material or other materials.

Under this textile layer 160 is placed an air chamber 162 illustrated in dashed lines in FIG. 4, the inflation valve (not illustrated) of this air chamber 162 being accessible from a plug 163 arranged on the textile layer 160 on the side of the bow of the craft 1, as shown in FIG. 2. The inflation of this air chamber 162 can be carried out during the inflation of the craft 1 for its use combined with the float 2, or even in case of need when the inflatable portion 3 of the float 2 is punctured, in order to transform the punctured craft 1 into a raft thanks to the inflated floor 16. The floor 16 comprises a dock 17 designed for example in wood or composite. The rear portion 164 of the textile layer 160 is integral with the dock 17, the junction edge 18 between said rear portion 164 and the dock 17 constituting a hinge allowing to pivot the dock 17 relative to the textile layer 160, as shown in FIGS. 6 and 7.

Figure 5:
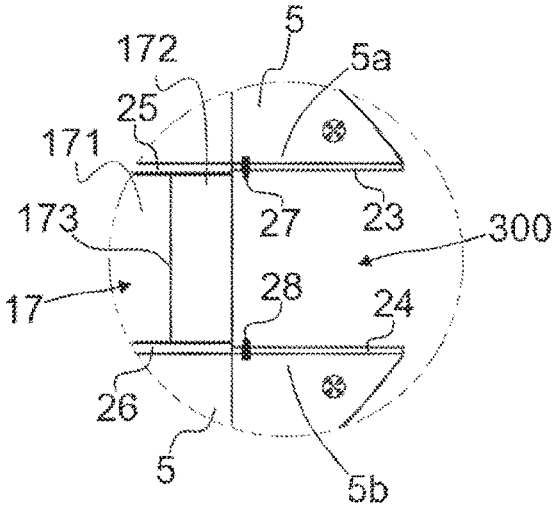
FIG. 5 shows a detail of representation denoted A in FIG. 2, according to a first configuration.
Figure 6:
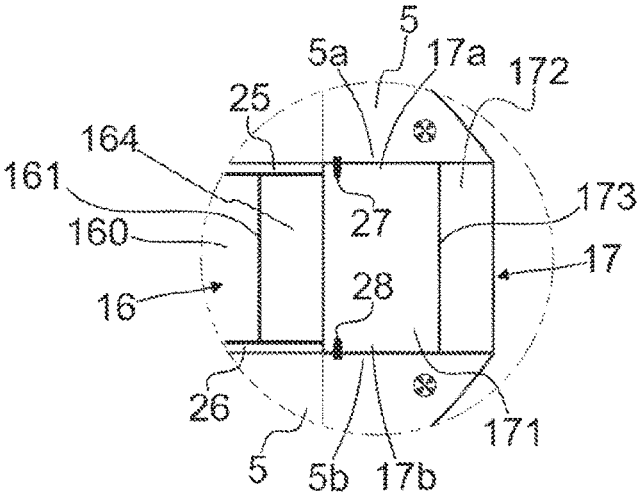
FIG. 6 shows a detail of representation denoted A in FIG. 2, according to a second configuration.
Figure 7:
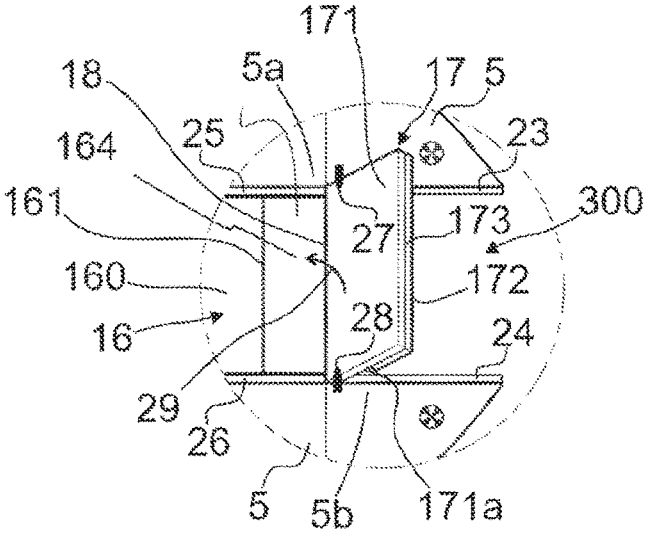
FIG. 7 shows a detail of representation denoted A in FIG. 2, according to a third configuration.

Referring to FIGS. 5 to 7, several possible configurations are shown for the dock 17 which is, according to this embodiment, hinged around the junction edge 18 forming a hinge. The dock 17 is composed of two portions 171, 172 hinged together by a hinge 173, in order to position them in the same plane as illustrated in FIGS. 5 and 6 or to fold them against each other as illustrated in FIG. 7 and to double the thickness of the dock 17 on a part 17*a* intended to receive the clamp presses of a support and inclination system (not illustrated) of a drive portion 201 of an engine 200.

As illustrated in FIGS. 2 and 5 to 7, two stop rails 23, 24 are arranged opposite each other on the internal sides 5*a*, 5*b* of the longitudinal arms 4, these two stop rails 23, 24 preferably having an L-shaped cross section and being disposed at the reduction area 9. These two stop rails 23, 24 are extended towards the front of the craft 1 by two guide rails 25, 26 preferably having a C-cross section forming a groove, these guide rails 25, 26 allowing the sliding reception of the lateral edges 164*a*, 164*b* of the rear portion 164 of the textile layer 160 and/or the lateral edges 17*a*, 17*b* of the dock 17 when its two portions 171, 172 are disposed flat in the same horizontal plane, resting against the stop rails 23, 24. The sliding of the dock 17 disposed flat in the two guide rails 25, 26 is possible thanks to the flexibility of the textile layer 160 which allows its deformation during the movement of said dock 17 in said guide rails 25, 26 towards the bow of the craft 1.

In FIG. 5, the dock 17 is slid in the two guide rails 25, 26, thus leaving an empty space 300 between the ends of the longitudinal edges 5, at the reduction area 9, this empty space 300 allowing to facilitate the boarding of swimmers from the rear.

In FIG. 6, the dock 17 is this time in the flat unfolded position and resting against the stop rails 23, 24 which allows to obtain a maximum floor surface 16, particularly useful for loading equipment from the platform or the loading pontoon in the craft 1.

In FIG. 7, the dock 17 has its two portions 171, 173 folded over one another at the hinge 173 and said dock 17 is folded upwards with respect to the rear portion 164 of the textile layer 160, so as to bring this dock 17 into a vertical position for fixing the engine 200. The rear ends of the two guide rails 25, 26 are also used as a stop so as to prevent the dock from pivoting towards the front 17 beyond its vertical position. Provision could be made of additional stop members fixed to the rear ends of the two guide rails 25, 26 and adapted to limit this forward pivoting of the dock 17 beyond its vertical position. Blocking means allow to maintain the dock 17 in a substantially vertical position, this configuration allowing to provide reception of the support and inclination system (not illustrated) of the drive portion 201 of the engine 200. Another advantage of this configuration is to allow a close position of the engine relative to the center of gravity of the craft 1 in order to improve the stability of the craft 1 and, in particular, allows to avoid excessive straightening of the bow when starting the engine or during acceleration while navigating.

According to a possible and non-limiting embodiment, these blocking means include beads implemented on the textile envelope 4, on the internal sides 5*a*, 5*b* of the longitudinal arms 5, these beads constituting blocking members 27, 28 (see FIGS. 5 to 7) of the dock 17 when it is in the vertical position with its two portions 171, 172 folded against each other. In FIG. 7, the dock 17 pivots forward in the direction of the arrow 29 and is about to cross the two blocking members 27, 28, the crossing being able to be done by force thanks to the possible retraction of the blocking members 27, 28, by deformation of the textile envelope 4, which then returns to the normal position once the dock 17 is placed vertically, the blocking members 27, 28 then being located behind the rear face 171*a* of the first portion 171 of said dock 17.

Figure 8:
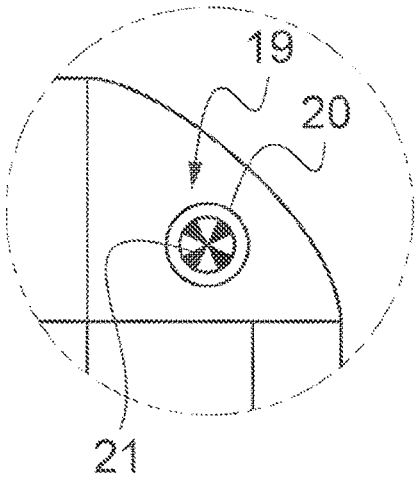
FIG. 8 shows in zoomed view a detail of representation denoted B in FIG. 2, according to a first configuration.
Figure 9:
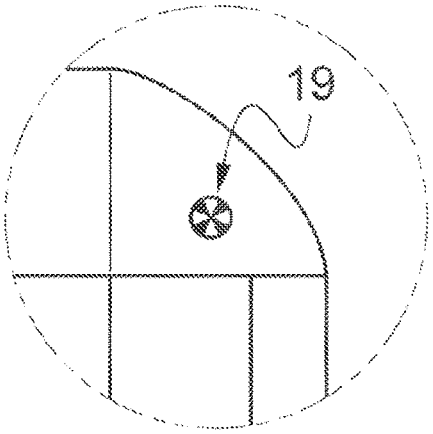
FIG. 9 shows in zoomed view a detail of representation denoted B in FIG. 2, according to a second configuration.
Figure 10:
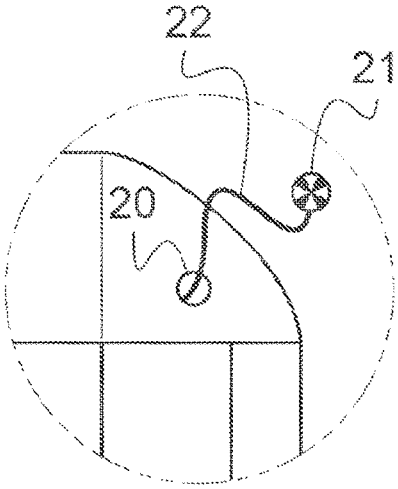
FIG. 10 shows in zoomed view a detail of representation denoted B in FIG. 2, according to a third configuration, FIG. 11 schematically shows the presence of longitudinal ribs implemented on the textile envelope, under the longitudinal arms of the float of the craft, FIG. 12 schematically shows in cross-section a lower portion of a longitudinal arm of the float of the craft.

Referring this time to FIGS. 8 to 10, means for inserting and removing 19 the inflatable portion 3 are shown. These insertion and removal means 19 include at least two orifices 20, one on each longitudinal arm 5, for the passage of the inflatable portion 3 into the textile envelope 4. The orifices 20 each include a cover 21 associated with a connection 22 allowing traction and movement of the inflatable portion 3 in the textile envelope 4.

More precisely, each connection 22 makes the junction between the respective cover 21 and a plug 12 arranged at the front end 2*a* of the float 2 so that when the two longitudinal branches 31, 32 of the inflatable portion 3 are respectively secured to the two connections 22, it is sufficient to pull on the latter to drive said longitudinal branches 31, 32 of the inflatable portion 3 in the longitudinal arms 5 of the textile envelope 4. Once the inflatable portion 3 positioned in the textile envelope 4, the connections 22 are slipped into the longitudinal arms 5 of the textile envelope 4 and the covers 21 are closed. Then an inflation valve 33 of the inflatable portion 3 is placed at an opening 40 on the textile envelope 4, said opening allowing the introduction of the inflatable portion 3 into the textile envelope 4 via the front end 2*a* of the float 2, and the plug 12 is screwed onto the inflation valve 33 to provide its closure and hold said inflation valve 33 in place at said opening 40.

To carry out the extraction, it is sufficient to open the plug 12 and pull the inflation valve 33 outwards through the opening 40 of the textile envelope 4, which then allows each longitudinal branch 31, 33 of the inflatable portion 3 to be extracted, the extractions of the longitudinal branches 31, 33 allowing to pull on the connections 22 to bring them back at the opening 40 at the front end 2*a* of the float 2 and to attach them to the ends 31*a*, 32*a* of the longitudinal branches 31, 32 of a new inflatable portion 3, said connections 22 then being pulled again through the two respective orifices 20 for the introduction of the new inflatable portion 3 into the textile envelope 4. Thus, it is possible to very quickly replace a damaged inflatable portion 3 with another and to repair the damaged inflatable portion without immobilizing the craft 1. Variants of the craft 1 could include more than two orifices 20 and covers 21 and more than two connections 22, in order to have more than one inflatable portion 3 in the textile envelope 4.

In the present case of FIGS. 1 to 10, with a single inflatable portion 3, the plug 12 is connected to the two covers 21 via the two connections 22 housed respectively in the two longitudinal arms 5 of the textile envelope 4. In a variant with two inflatable portions housed respectively in the two longitudinal arms 5 of the textile envelope 4, it would be appropriate to provide two plugs similar to the plug 12 and connected respectively to the two covers 21 via the two respective connections 22, these plugs then closing two inflation valves similar to the inflation valve 33, arranged respectively on the two inflatable portions and placed respectively at two openings similar to the opening 40, arranged on the textile envelope 4 at the front end 2*a* of the float 2.

Figure 11:
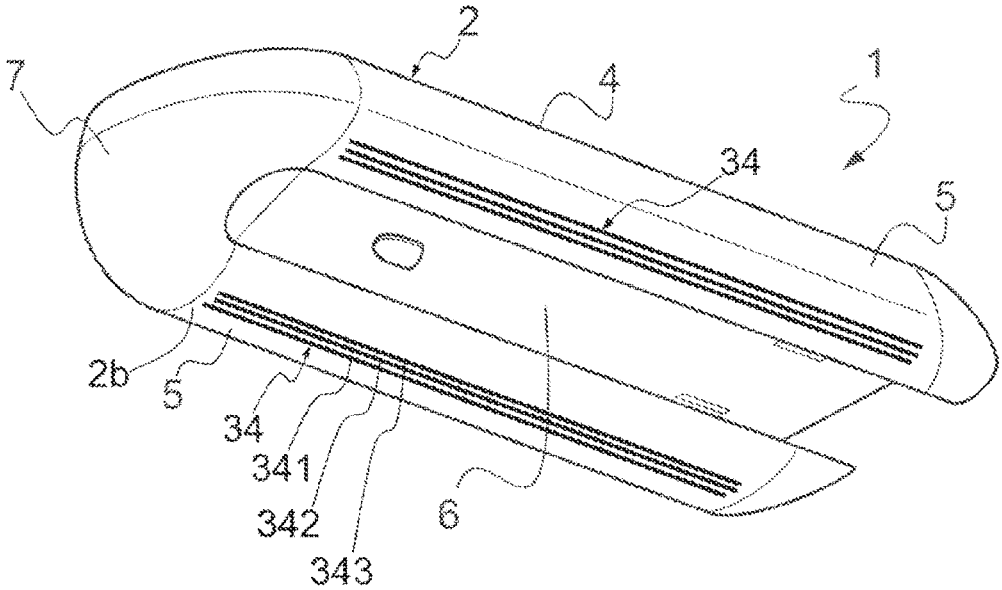
Figure 12:
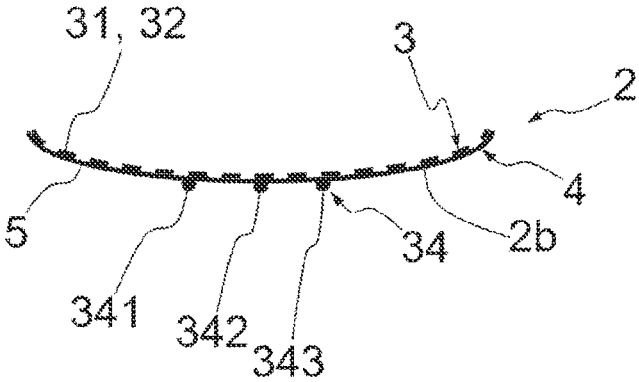

According to an alternative embodiment illustrated with reference to FIGS. 11 and 12, the craft 1 comprises ribs 34 which are arranged in the longitudinal direction of the float 2, on its lower side 2*b* and on each of its two longitudinal arms 5. Preferably, three ribs 341, 342, 343 are arranged on each of the two longitudinal arms 5, but this number could be different, for example one, two, four or five ribs could be present on each longitudinal arm 5. These ribs 34 are implemented by knitting directly on the textile envelope 4, during knitting thereof as described above. This provides great robustness to the ribs 34 which are heavily stressed when the craft 1 is dragged or quickly docks on a bedrock or rocky seashore. Thus, the presence of ribs 34 prevents premature wear of the textile envelope 4 during use of the craft, particularly during rescue operations at sea. In FIG. 12, the inflatable portion 3 is deliberately illustrated in dotted lines in order to distinguish it from the textile envelope 4 against which it is pressed once inflated.

The present invention further relates to a method for manufacturing an inflatable craft 1 as mentioned above.

The manufacturing method essentially consists in carrying out the following steps:

- a step of manufacturing by integral knitting with picked meshes of a textile envelope 4 without seam at the general structure of the textile envelope 4,
- a step of manufacturing an inflatable portion 3 in the form of a cylinder closed at the ends,
- a step of inserting the inflatable portion 3 into the textile envelope 4.

A step of inflating the inflatable portion 3 disposed in the textile portion 4 may be provided during the manufacture of the craft 1, in order to control the design. However, this inflation can be provided during the first use of the craft 1. This inflation will provide the shape and mechanical structure of the float 2.

Of course, other features of the invention could also have been considered without departing from the scope of the invention.

The invention claimed is:

1. An inflatable craft including at least one float comprising:

at least one inflatable portion providing flotation; and a textile envelope configured to receive said at least one inflatable portion and to provide a shape and mechanical strength of said at least one float, the textile envelope comprising means for inserting and removing the at least one inflatable portion, the insertion and removal means including at least two orifices each Including a cover associated with a connection allowing traction for the passage of the at least one inflatable portion into the textile envelope.

2. The craft according to claim 1, wherein the at least one float is substantially V- or U-shaped with two longitudinal arms, said textile envelope providing the reception of the at least one inflatable portion and the connection between the two longitudinal arms by a central connection area.

3. The craft according to claim 1, wherein the textile envelope is made from straight, warp and weft knitting in 3D.

4. The craft according to claim 1 wherein a knitted fabric of the textile envelope includes at least one increase area to locally allow an increase in the diameter of the at least one inflatable portion so as to produce a float profile of greater section.

5. The craft according to claim 4, wherein a bow of the craft comprises an increase area for seakeeping, at the bow of the craft and wherein the increase in the size of the mesh is comprised between 2% and 20% of the mesh.

6. The craft according to claim 1, wherein a knitted fabric of the textile envelope includes at least one reduction area of a section with a reduction in a number of meshes per row comprised between 1% and 20% allowing a float profile of lower section.

7. The craft according to claim 1, wherein a knitted fabric of the textile envelope includes at least one flexible area, at least at one front and/or rear end of the craft, wherein the knitted fabric is made from a low tenacity elastic yarn to allow the limitation of overpressures due to thermal expansion.

8. The craft according to claim 7, wherein the low tenacity elastic yarn has an elasticity allowing an elongation comprised between 5% and 15%.

9. The craft according to claim 1, wherein the at least one float is substantially V- or U-shaped with two longitudinal arms and a central connection area connecting the two longitudinal arms, said central connection area including a floor.

10. The craft according to claim 9, wherein a dock of the floor is mounted on a pivot, the at least one float including blocking members implemented on internal sides of the longitudinal arms that block the dock when the dock is in a substantially vertical position to provide reception of a support and inclination system for a drive portion of an engine.

11. The craft according to claim 1 further comprising at least one fin removably mounted on the at least one float.

12. The craft according to claim 1, wherein the at least one float is substantially V-shaped or U-shaped with two longitudinal arms and a central connection area connecting the two longitudinal arms, said central connection area being raised relative to a lower side of the at least one float and including on its lower face a fixing member for attaching a propulsion machine.

13. The craft according to claim 1, wherein the at least one float is substantially V-shaped or U-shaped with two longitudinal arms and comprises a lower side, at least one reinforcing rib being arranged on the textile envelope in a longitudinal direction of the longitudinal arms, on said lower side and on each of said two longitudinal arms.

14. The craft according to claim 13, wherein the textile envelope is implemented by knitting, said at least one rib on each of said longitudinal arms being implemented directly by knitting said textile envelope.

* * * * *